US005232224A

United States Patent [19]

Zeider

[11] Patent Number: 5,232,224

[45] Date of Patent: Aug. 3, 1993

[54] GOLF CLUB HEAD AND METHOD OF MANUFACTURE

[76] Inventor: Robert L. Zeider, 487 Calle San Pablo, Unit B, Camarillo, Calif. 93012

[21] Appl. No.: 932,713

[22] Filed: Aug. 18, 1992

Related U.S. Application Data

[63] Continuation of Ser. No. 742,027, Aug. 8, 1991, abandoned, which is a continuation-in-part of Ser. No. 468,223, Jan. 22, 1990, abandoned.

[51] Int. Cl.[5] ..... A63B 53/04

[52] U.S. Cl. ..... 273/167 H; 273/80.2

[58] Field of Search ..... 273/167 H, 167 K, 80.1-80.8, 273/169, 173, 167 F, 167 G, 167 J

[56] References Cited

U.S. PATENT DOCUMENTS

| | | | |
|---|---|---|---|
| 1,235,922 | 8/1917 | Pittar | 273/80.1 |
| 3,819,181 | 6/1974 | Mills | 273/80.2 |
| 4,438,931 | 3/1984 | Motomiya | 273/167 H |
| 4,762,322 | 8/1988 | Molitor et al. | 273/167 H |
| 4,874,171 | 10/1989 | Ezaki et al. | 273/167 H |

*Primary Examiner*—V. Millin
*Assistant Examiner*—Steven Wong
*Attorney, Agent, or Firm*—Brown, Martin, Haller & McClain

[57] ABSTRACT

A golf club head of the metal-wood type is made from several components welded together along parting lines. A head base has a sole plate formed integrally with a heel, toe and back wall for the club, and has open front and upper faces across which a face plate and crown plate, respectively, are welded. The base, face plate and crown plate are all stamped sheet metal parts. A hosel tube projects upwardly at a desired lie angle from the base through an opening in the crown plate. The various parts are held together at selected loft and lie angles in suitable holding fixtures before being welded in place, so that heads can be custom made with different head geometries using the same basic tooling.

7 Claims, 3 Drawing Sheets

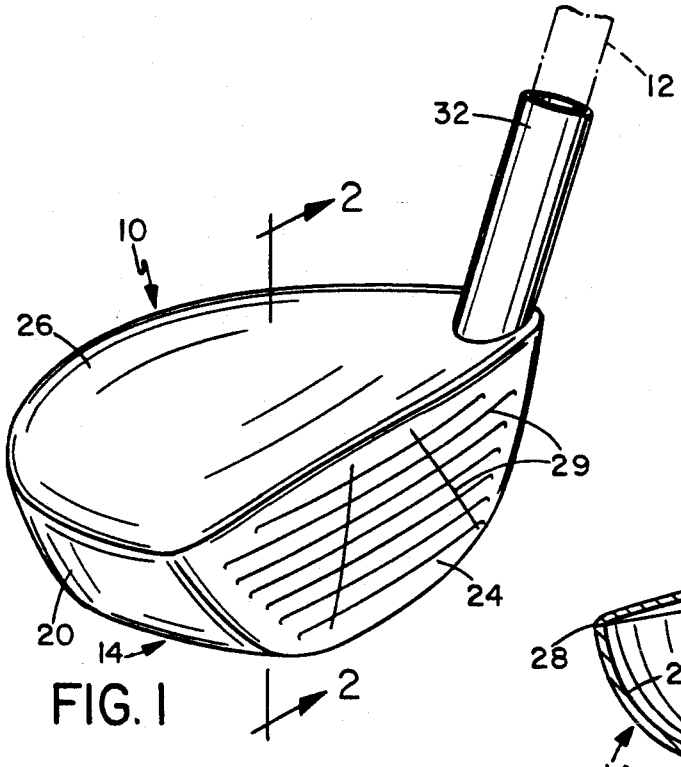
FIG. 1
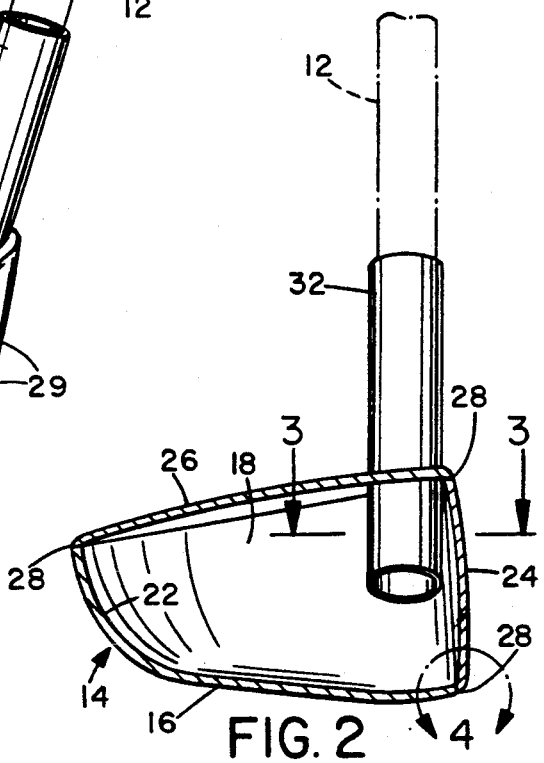
FIG. 2
FIG. 5
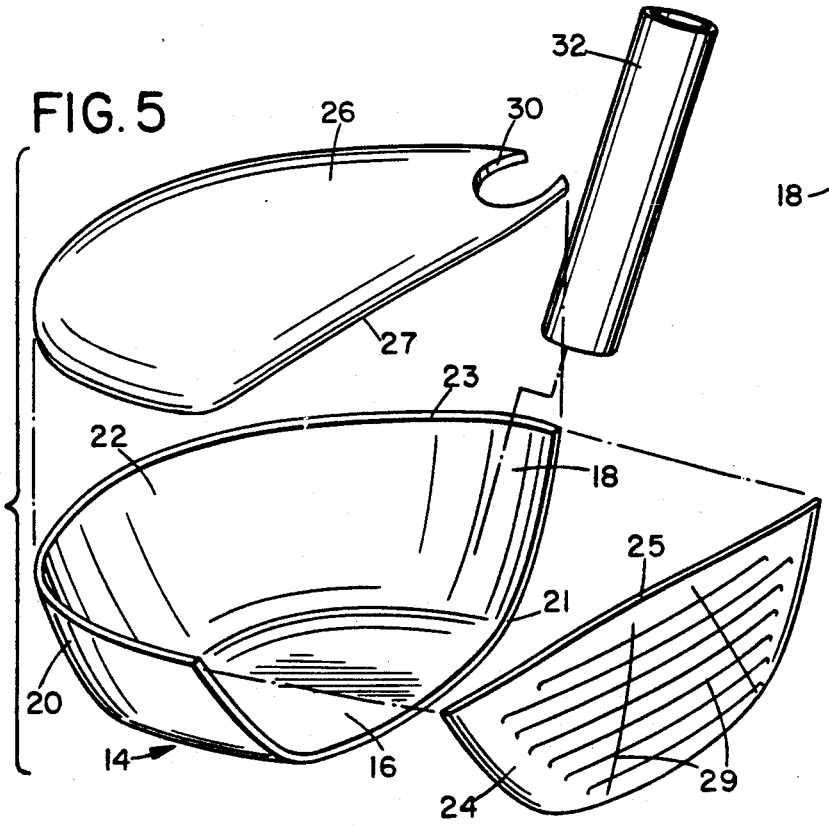
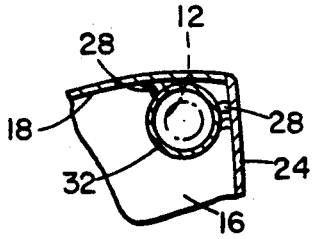
FIG. 3
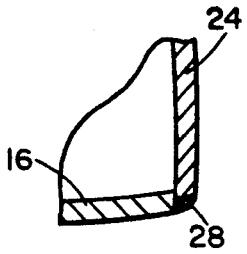
FIG. 4

GOLF CLUB HEAD AND METHOD OF MANUFACTURE

CROSS-REFERENCES TO RELATED APPLICATIONS

This application is a continuation of application Ser. No. 07/742,027 filed Aug. 8, 1991 now abandoned, which was a continuation in part of application Ser. No. 07/468,223 of the same Applicant, which was filed on Jan. 22, 1990 now abandoned.

BACKGROUND OF THE INVENTION

This invention relates generally to golf club heads of the so-called metal-wood type, and to methods of making such heads.

Golf club heads of the so-called metal-wood type are well known in the art for use in place of traditional wooden headed clubs such as drivers, 3-woods, and the like. Metal-wood clubs typically have a hollow club head formed from cast metal components, such as stainless steel or the like. A typical cast head is formed by separately casting a sole plate and a downwardly opening head shell, and then welding the sole plate onto the cast head shell. The geometry of the metal club head generally is selected to conform with that of the corresponding wooden headed club. The hollow interior of the head is often filled with foam or other material to reduce the "ping" noise resulting from impact with a ball.

Metal-wood club heads are relatively difficult and expensive to manufacture. Metal casting techniques inherently produce a variety of surface imperfections, such as pit holes or other blemishes, which are difficult and time consuming to remove. Excess grinding to remove such blemishes can adversely affect head weight distribution as well as structural integrity, and also results in variations in the head geometry from club to club. Because of this scrap rates as high as 30 percent are normal in the field, considerably increasing production costs. Even with these scrap rates, the standard error in loft angle of the striking face of a cast metal wood club head is typically of the order of $\pm 1°$, which can cause a significant difference in operation from club to club.

Another problem is that the casting process is inherently expensive and does not allow the head geometry to be varied without significant additional expense. In the golfing field, different individuals will have different requirements as regards such variables as loft angle, lie or inclination angle of the club shaft, as well as the amount the striking face is open or closed (i.e. the angle from toe to heel of the club). Lie angle is very important when fitting a golf club to a particular golfer. When the player is striking a golf ball, it is important that the sole of the club is seated perfectly with respect to the ground. Thus, a taller player would need to have a shaft with a greater lie angle (more upright) than a shorter person whose hands will be closer to the ground. The amount the face of the club is open or closed will also be very important to a golfer, depending on their experience level, and can be used to control any tendency to hook or slice the ball. Additionally, variation in the loft angle or vertical inclination of the face plate is desirable between stronger and weaker players. A weaker golfer requires more face loft angle to compensate for lack of club head velocity, whereas strong players typically prefer a club with less than average loft angle.

Each specific club head having a certain loft angle, shaft angle, and face angle from heel to toe, typically requires a unique set of relatively costly casting dies. Thus, several sets of casting dies are needed to provide even a relatively small range of different club head geometries which will not be ideal for every individual.

SUMMARY OF THE INVENTION

It is an object of the present invention to provide a new and improved golf club head of the metal wood type, and a new and improved method of manufacturing such a golf club head.

According to one aspect of the present invention, a golf club head is provided which comprises a plurality of components welded together in assembled relation to define a hollow golf club head of the metal-wood type, the components comprising a head base having a sole plate, heel, toe and back wall with an open front face and an open top face, a face plate welded across the open front face of the base, a crown plate having a smooth upper surface with no protrusions welded across the open top face, and a hosel tube secured to project upwardly from the crown plate at any one of a range of possible angles to the crown plate. The base, face plate and crown plate are all stamped sheet metal parts.

Preferably, the crown plate has a recess at its outer peripheral edge adjacent the heel of the base, the hosel tube diameter being less than the dimensions of the recess and the hosel tube extending through the recess into the interior of the head, the gap between the hosel tube and periphery of the recess allowing some free play for angular adjustment of the hosel tube prior to welding in place. The crown plate is substantially flat.

The open front face of the base is formed at a predetermined loft angle so that when the face plate is welded flat against the opening it will have a corresponding loft angle. The open front face can be machined at a range of different loft angles to suit different players.

According to another aspect of the present invention, a method of making a golf club head of the metal-wood type is provided, which comprises the steps of stamping a head base, face plate and crown plate from sheet metal material, the head base being stamped to form a sole plate integrally with a heel, toe and back wall, and having an open front face and open top face, securing the face plate to the open front face of the base at a selected loft angle, and securing the crown plate and a hosel tube to the open top face of the base with the hosel tube projecting at any one of a range of possible lie angles from the crown plate.

Preferably, the open front face of the base is machined around its periphery to the desired loft angle, so that when the face plate is welded flat against the open front face it will be at the same loft angle. Additionally, the hosel tube is held in the base at the desired lie angle via an adjustable holding fixture before being secured in place. The crown plate is subsequently welded over the open front face and secured to the hosel tube.

In this way, a golf club head can be custom made at little additional expense to any desired face plate loft and shaft lie angle. The same basic stamped sheet metal components are used for the entire range of angles, and are simply adjusted after stamping to achieve the desired angles. Thus, the same stamping dies may be used for all heads of that particular number club, regardless of their geometry, considerably reducing manufacturing expense. All that is necessary to adjust the loft angle during manufacture is to machine the open front face of the base or shell before welding the face plate flat against the angled front face. In order to adjust the shaft lie angle, the hosel tube is held at the desired angle to the base before securing in place, and the crown plate is then placed over the open top face and secured in place to complete the assembly. The crown plate will be formed with a suitable recess for surrounding the hosel tube, the recess being larger than the tube diameter so that the tube can extend at any desired lie angle through the crown plate.

The hosel tube front to back orientation relative to the base can also be adjusted to control the heel to toe angle of the face plate, in other words to control whether the face plate is open, closed, or normal in the striking position. Additionally, face progression can be adjusted easily. This method allows a metal wood to be custom made quickly and easily for any individual golfer at relatively little additional expense.

The club head will be more uniform and precise in its characteristics than a similar cast metal-wood club head, since cold stamped sheet metal does not have the weight variations of a cast metal. As molten material cools, it contracts, and the amount of contraction will vary both over the area of the club head and from one club head to the next. This method which avoids any heating of the metal avoids such problems. The stamping technique allows the part to have a uniform thickness over the entire face and the walls can be made thinner than is possible with casted material. The method also avoids the pit holes and other blemishes which result from an investment casting process, avoiding the need for excess grinding to remove blemishes. Thus, the method produces a stronger but lighter club with more accurate weight distribution than a casted metal-wood. Since sheet metal is inherently smooth, less grinding and finishing is needed than with a corresponding casted head which will have more pores and pit holes.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which:

FIG. 1 is a perspective view of an assembled golf club head of the metal-wood type according to a preferred embodiment of the present invention;

FIG. 2 is a vertical section of the head taken on the lines 2—2 of FIG. 1;

FIG. 3 is a fragmented horizontal section taken on the line 3—3 of FIG. 2;

FIG. 4 is an enlarged fragmented vertical sectional view corresponding generally with the encircled region 4 of FIG. 2;

FIG. 5 is an exploded perspective view illustrating assembly of the club head components;

DESCRIPTION OF THE PREFERRED EMBODIMENT

Figure 6:
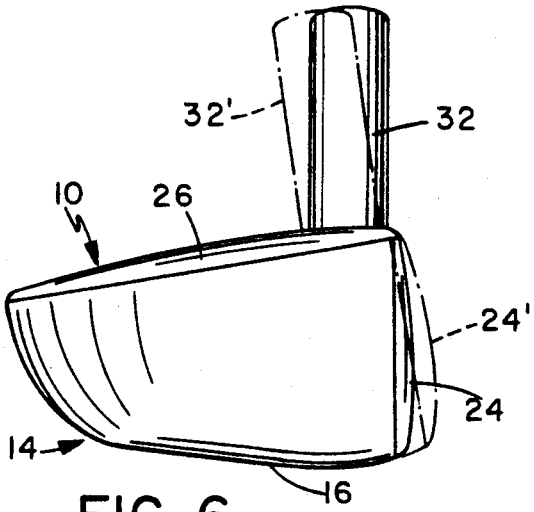
FIG. 6 is a side elevation view of the head showing some alternative face loft angles.

FIGS. 1–7 illustrate a metal-wood club head 10 according to a preferred embodiment of the present invention, while FIGS. 8–14 illustrate steps in a preferred method of making the head 10 according to the invention.

The golf club head 10 is made from several components which are secured together by welding or the like to form a hollow golf club head of the metal-wood type, which is then attached to a club handle shaft 12. The first component of the head is a head base or shell 14 which has a sole plate 16 formed integrally with a contoured outer wall forming the heel 18 and toe 20 which merge smoothly with back wall 22 of the head. The resultant base or shell has an open front face with a peripheral rim 21 and open top face with a peripheral rim 23. A substantially flat face plate 24 is shaped to fit over the open front face of the base and is welded or otherwise secured around its periphery 25 to the peripheral rim 21 of the front opening of the base, for example via line weld 28 as illustrated in FIG. 4. The face plate has score lines 29 on its outer, striking face, which is slightly rounded while the inner face is flat.

A crown plate 26 is similarly shaped to fit over the open top face of the base but has a recess or opening 30 formed adjacent the heel end of the head. The crown plate is welded or otherwise secured around its peripheral edge 27 to the peripheral rim 23 of the open top of the base and to the top edge of the face plate, so that it extends across the open top face of the base as illustrated in FIG. 5 but leaves an opening 30 into the interior of the base. The base, face plate and crown plate are all formed by stamping from a sheet metal material of suitable strength and durability, such as stainless steel, titanium, aluminum, brass or the like.

As illustrated in FIGS. 1 and 2, a hosel tube 32 projects upwardly from the base through the recess 30 in the crown plate. The handle shaft 12 of the club is secured in the hosel tube 32 in a standard manner. The hosel is formed from a suitable metal tubing such as stainless steel tubing having an inner diameter large enough to fit over the outer diameter of the golf club shaft 12. The hosel tube is welded around its periphery to the periphery of recess 30 and to the adjacent regions of the base along its end which projects into the base via line weld 28 or the like, as illustrated in FIG. 3, with the external weld region being formed into a smooth radius in the finished club.

With this arrangement of a club head formed from three stamped sheet metal parts and a hosel tube, it is relatively easy to make adjustments in the golf club head geometry by varying the face plate loft angle, the handle shaft lie angle, and varying the amount by which the face plate is open, closed or normal in the normal ball striking position FIGS. 8–14 illustrate steps in manufacture of a club head as illustrated in FIGS. 1–7, in which these parameters can be adjusted quickly, easily and inexpensively during the manufacturing process.

Figure 8:
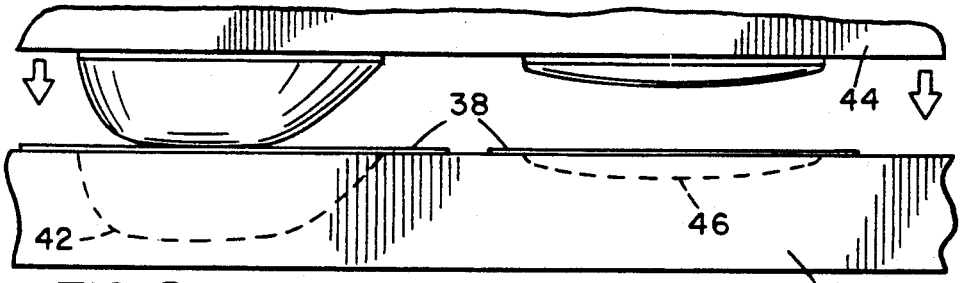
FIG. 8 illustrates a typical press arrangement for forming parts of the head.

As mentioned above, the base or shell, face plate and crown plate are all made by stamping from a suitable sheet metal material such as stainless steel. These parts may be stamped simultaneously from sheet metal 38 in a progressive forming die 40 as illustrated in FIG. 8. The first blanking die recess 42 of die 40 is opposed by press 44 which stamps the flat blank 38 in the desired shape. A second forming and embossing die may be used to form the sole and sides and to mark the part with any desired insignia, and a third trimming die may be used for shaving off any excess material. Alternatively, these operations may all be done in three steps or progressions in a single die. First, the excess material is clipped off. Subsequently, the base shape is formed and embossed, and finally any excess material is trimmed off. Alternatively, a pinch off die may be used to form, emboss and blank the part in one stroke of the press.

FIG. 8 also illustrates the step of stamping the face plate in face plate blanking die 46 via opposing press 44. The press embosses scoring lines 29 as desired on the striking face during the stamping operation. The crown plate is suitably stamped in the desired shape and dimensions in a similar manner.

The hosel is made out of suitable straight cylindrical metal tubing, such as stainless steel tubing, cut to the desired length and having an internal diameter sized to fit over the outer diameter of the golf club shaft.

FIGS. 9–14 illustrate how the four parts of the head are assembled together. First, the forward margin or peripheral edge 21 of the open front face of the base is machined or cut back to define the desired loft angle. The loft angle of a club head, or its tilt from a vertical orientation, is an important factor depending on the strength and swing technique, as well as the experience of a player. Basically, the loft angle will help to determine the backspin, and thus the lift developed on the ball, so that the ball can stay in the air a longer distance. A weaker player will require more face loft angle to compensate for lack of club head velocity and to optimize results. Some players may tend to strike a ball more on the upswing, and a smaller loft angle can compensate for this. A driver with less than average loft will be the choice for skilled players. Thus, heads are normally needed with loft angles in a range from around 7° to 22°, and each head can be custom made to a specific desired loft angle simply by machining the forward peripheral edge 21 so that the open front face of the base is at the desired loft angle.

Figure 9:
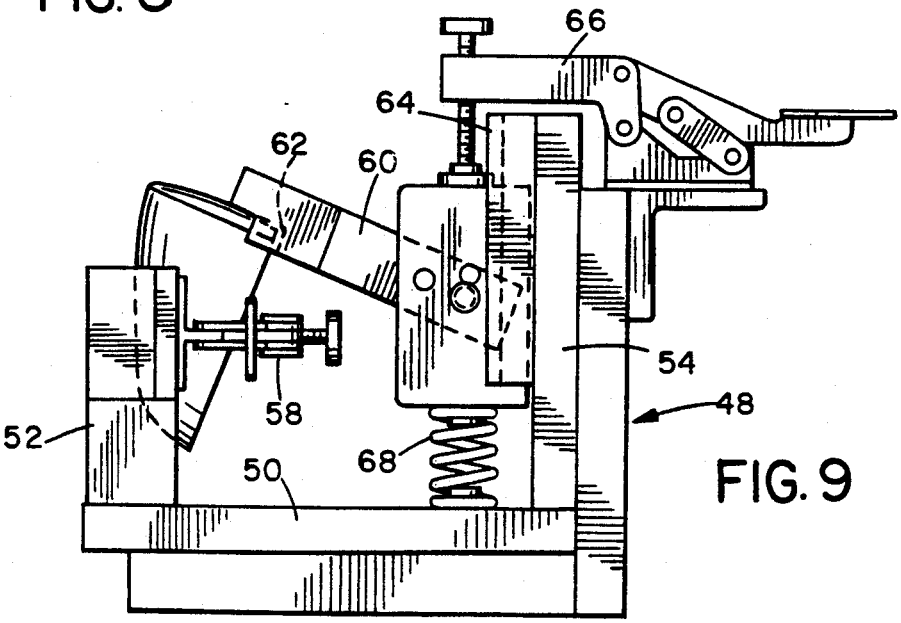
FIG. 9 is a side elevation view of an assembly fixture for tack welding the face plate to the base shell.
Figure 10:
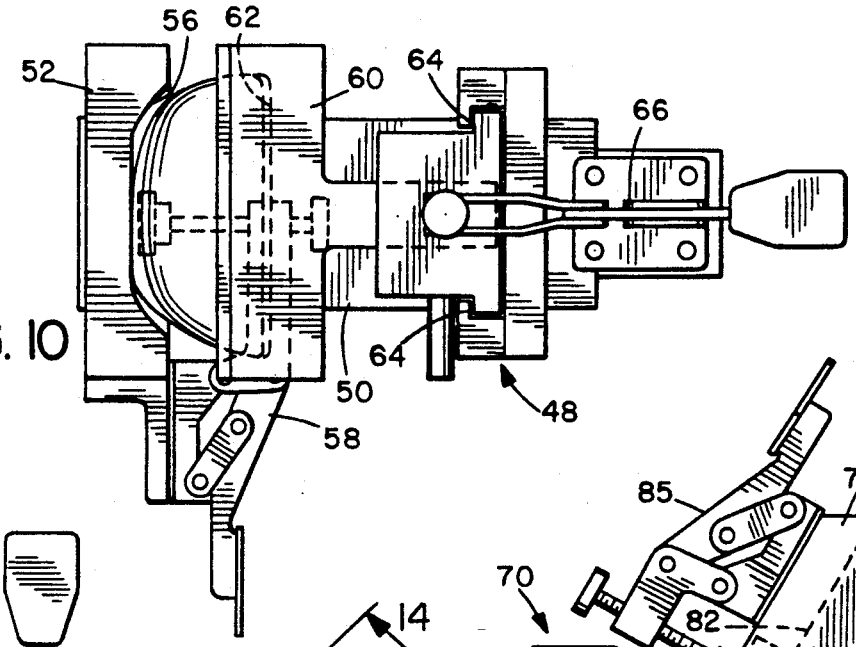
FIG. 10 is a top plan view of the fixture of FIG. 9.

In order to adjust the loft angle and attach the face plate, the base is placed in the first welding fixture 48 illustrated in FIGS. 9 and 10. Welding fixture 48 is designed to hold the face plate 24 against the open front face of the base while the parts are tack welded together. Fixture 48 includes a base plate 50 from which first and second support posts 52 and 54 project upwardly. The first support post has a nest or recess 56 (see FIG. 10) for locating base 14 with its open front face facing generally upwardly, and a toggle clamp 58 clamps the sole plate of the base against the recess to hold the base in position. The second support post has a pivotal clamping arm or toggle clamp 60 projecting outwardly towards the first support post. Arm 60 has a recess 62 for locating over one edge of the face plate 24, and can be locked in any desired angular position to hold the face plate 24 flat against the open front face of the base, as illustrated in FIG. 9. Clamping arm 60 is slidably mounted in rails 64 to accommodate different head dimensions, and is held in a selected vertical position with a further toggle clamp 66 against the biassing spring 68.

With this arrangement, any desired loft angle can be accommodated quickly and easily, simply by first machining the peripheral rim 21 of the open front face to the desired angle, which may be done with a suitable grinding tool, for example, while the base is held in fixture 48. The face plate is then supported flat against peripheral rim 21 and held in place by arm 60, which is released and pivoted into engagement with the face plate before locking it in position. At this point, the face plate is tack welded to the base at the desired loft angle. FIG. 6 illustrates head face plates 24, 24' at two possible face loft angles, from a substantially vertical face plate 24 as in solid line for a more skilled player, to a larger tilt angle of face plate 24' as illustrated in dotted outline in FIG. 6. With this method, loft angles covering the entire useful range can be provided as desired, for example at any angle from around 7° to 22°.

Figure 12:
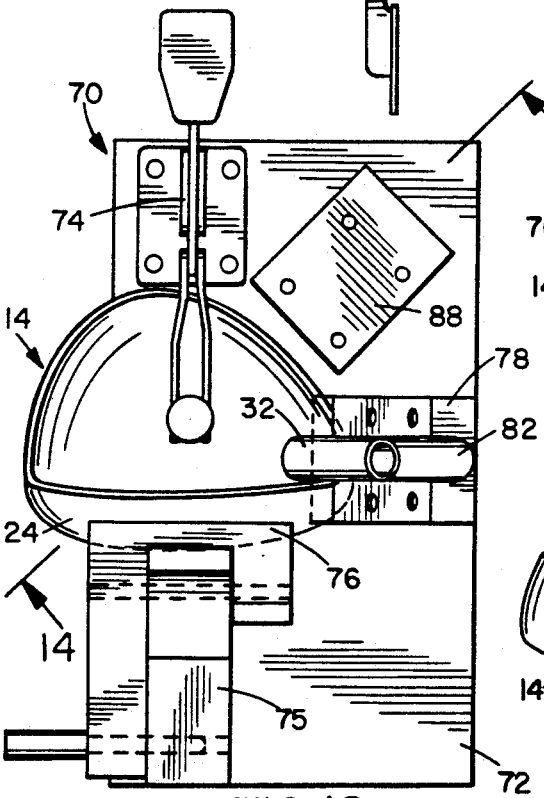
FIG. 12 is a top plan view of the fixture of FIG. 11, the hosel clamp being omitted for clarity.
Figure 13:
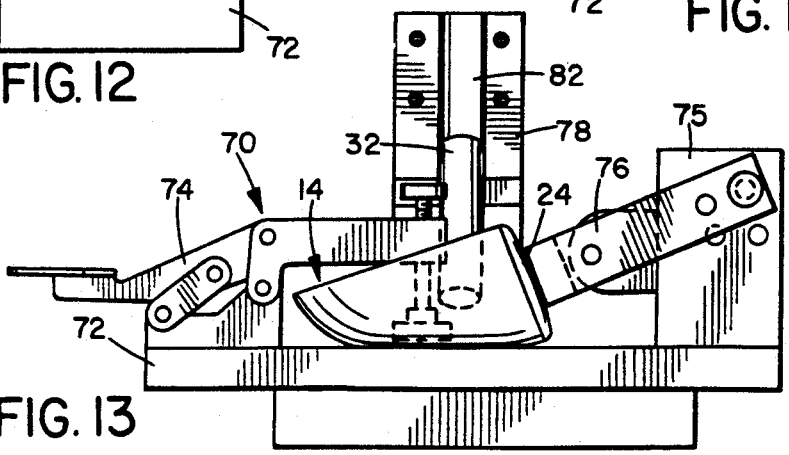
FIG. 13 is a view as taken from the left hand side of FIG. 11, with the hosel clamp omitted.

Another variable in metal-wood club heads is the lie angle, or angle of the handle shaft. With the arrangement of parts described above, different lie angles can also be accommodated easily, and a second welding fixture 70 is provided for this purpose, as illustrated in FIGS. 12–13. Lie angle is a very important factor when fitting a golf club to a particular golfer. It is important that the angle between the sole of the golf club and the handle shaft is such that, when the player is addressing the ball, the sole plate is flat on the ground. If this is not the case the ball will be directed to the right or left of the intended line of flight, depending on whether the heel or toe is elevated. A tall person will therefore require a greater or more upright lie angle than a short person, whose hands are closer to the ground.

Figure 7:
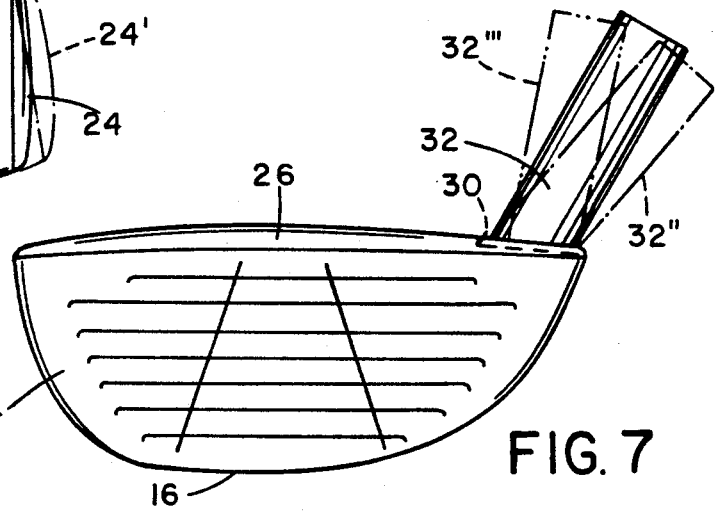
FIG. 7 is a front face view of the head showing some of the alternative lie angles which can be provided.

The four parts making up the club head of this invention are designed to allow the lie angle to be varied as needed. As explained above, hosel tube 32 extends through opening 30 in the crown plate 26, which is substantially flat with no protuberances. Opening 30 is of larger dimensions than the diameter of hosel tube 32, to leave a clearance between the tube and opening 30 so that the tube can be tilted in the opening relative to the base, for example between the orientations 32, 32', and 32'' as illustrated in FIG. 7. The selected hosel tube orientation will control the lie angle of the golf club shaft when inserted and attached to tube 32. The opening 30 must be large enough to allow the hosel tube to pass through it at any desired lie angle. Thus, the opening has dimensions equal to or greater than the cross-sectional dimensions of the hosel tube at the point it enters the base at the desired maximum lie angle.

Figure 11:
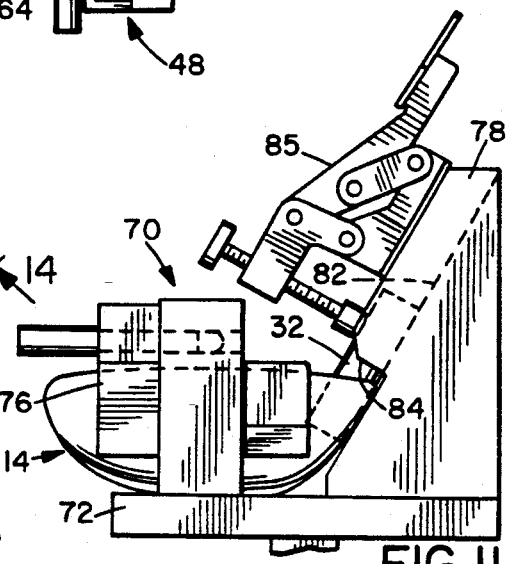
FIG. 11 is a side elevation view of an assembly fixture for tack welding the hosel in place in the base shell.

The welding fixture 70 illustrated in FIGS. 11–13 is designed to hold the hosel tube at the desired lie angle orientation while it is tack welded to the base. As well as allowing the sideways orientation or lie angle of the tube 32 to be adjusted, fixture 70 also allows the front to rear orientation of the tube to be adjusted, in order to vary the amount the face plate of the club will be open or closed when the player addresses the ball. This can also be a very important factor, depending on the skill of the player. For example, a built-in closed face can make golfing more enjoyable to the player who tends to slice his or her drives. A stronger golfer would want the club face to be "open" a few degrees in order to compensate for the effect of centrifugal force causing the shaft to bend forwardly when the club is swung at high speed. Fixture 70, along with the size of opening 30, allows both of these factors to be adjusted quickly and easily.

Fixture 70 basically comprises a base plate 72 having a conventional toggle clamp 74 at one end for extending into the base 14 to clamp the sole plate in the position illustrated in FIG. 13. A support post 75 projects upwardly from the other end of the base plate, and a pivotally mounted locating arm 76 extends inwardly from the support post for engagement with face plate 24. Locating arm 76 can be adjusted to locate flat against the face plate 24 at any face plate angle, before locking in place to hold the base and attached face plate in position. One of a series of different hosel locating blocks 78 is releasably secured to the base plate via screw fasteners or the like. Each hosel locating block has an inclined channel 82 on its inner face which is orientated at one of a range of different lie angles. The lower end 84 of channel 82 is positioned above the heel end of the base 14, as best illustrated in FIG. 11, and a hosel tube 32 is positioned in channel 82 to project partially into the base at the desired angle. The hosel locating blocks will also be provided with different front to rear orientations to allow clubs to be made with the face plate open, closed, or normal, with the block in FIGS. 11–13 illustrating a normal orientation. Once the hosel tube is positioned in channel 82, it is clamped in place by vise clamp 85, as illustrated in FIG. 11.

Figure 14:
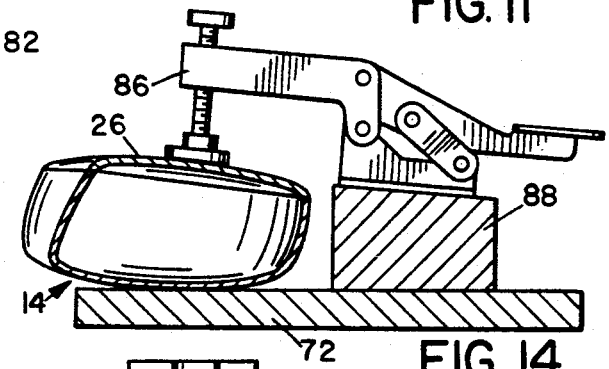
FIG. 14 is a sectional view taken on line 14—14 of FIG. 12, showing a further clamping of the crown plate.

Once the appropriate hosel locating block has been selected and the hosel tube has been clamped in the channel so as to project into the toe end of the base, the hosel tube is welded in place to the adjacent portions of the base and face plate. The hosel tube does not need to project into the base as far as the sole plate, but may do so if additional strength is required. While the assembled parts are held in the same fixture 70, the crown plate 26 is positioned over the open upper face of the base as illustrated in FIG. 14, with opening 30 extending around the hosel tube. The crown plate is held in position by toggle clamp 86 supported on base 88. The crown plate may also have tabs at its periphery for locating over the side walls of the base, for easier assembly. The crown plate is then tack welded around its periphery to the peripheral rim 23 of the open upper face of the base, and around the periphery of opening 30 to the perimeter of the hosel tube, with sufficient weld material to fill the gap between the opening 30 and tube 32.

When everything has been tack welded in place, the club head is welded around all of the parting lines, making sure it is all welded properly. There will be an excessive amount of welding to fill in the gaps around where the hosel connects to the shell, face and crown. This will be removed and blended into a radius for a uniform look. After welding is finished, the head is ground off to form an even, smooth finish, such as a sandblast, bright polish, or tumble finish, or a combination of these three finishes on different surfaces of the head, as desired. The inherent smoothness of the sheet metal making up all parts of the head enhances the finish.

This process has unique advantages over previous processes used to make metal-woods, since the various parts can be adjusted in the various welding fixtures quickly and easily to produce different lie angles, loft angles and face progressions, as well as faces which are open, closed, or normal. This essentially allows a club head to be custom made to a particular player's requirements quickly, easily and inexpensively, without the need for a separate set of investment casting molds for every different head of a particular number club. This process therefore reduces tooling costs considerably while at the same time making a much larger range of different head geometries readily available in each specific club number.

Another advantage over a casting process is that the club is made of sheet metal stock, such as stainless steel, titanium, aluminum, brass or the like. Sheet metal is much less porous than cast metal and is also notably stronger. There will also be much less weight variation than would occur in a casting process, resulting in a stronger, lighter club with more accurate, uniform weight distribution. This process also produces club heads in which the striking face is orientated to a greater degree of accuracy. In a cast head, due to uneven shrinkage on cooling, variations will occur from head to head, and these variations are substantially reduced in the present method which involves no heating of the metal.

The club head can be stamped and formed out of very thin material, unlike a cast head, so that the head will be lighter. Thus, this head can be made larger than normal while still keeping within the weight guidelines of the PGA. The hollow head interior may be filled with foam, weights, or other materials to customize head weight, sound and feel characteristics prior to attachment of the crown plate. For example, metal slugs may be welded inside the base and face plate in strategic areas to improve the balance and play-ability of the club. Because of the relatively light weight of the hollow, thin sheet metal head, such weights can be added without needing to reduce the size of the head to stay within weight requirements.

With this method, a club head can be ready for shafting in a matter of hours, unlike the known investment casting process which typically takes a few days before the head is ready for shafting.

Although a preferred embodiment of the present invention has been described above by way of example only, it will be understood by those skilled in the field that modifications may be made to the disclosed embodiment without departing from the scope of the invention, which is defined by the appended claims.

I claim:

1. A golf club head, comprising:

a plurality of components welded together in assembled relation to define a hollow golf club head of the metal-wood type;

the components comprising a head base having a sole plate, heel, toe and back wall for said club head, the base having an open front face and a substantially flat open top face, the open front face having a lower edge and spaced side edges each comprising flat, forwardly-facing edges, the side edges terminating at a junction with the open top face, a face plate welded across the open front face of said base, a crown plate having a smooth upper surface with no protrusions welded across the open top face of said base, and a hosel tube secured to project upwardly from the crown plate at any one of a range of possible angles to the crown plate;

the flat side and lower edges at the open front face comprising means for being machined to a selected loft angle;

the crown plate having an opening at its outer peripheral edge adjacent the heel of said base;

the hosel tube extending through said opening into the interior of the head, the opening being of predetermined dimensions greater than the diameter of said hosel tube by a predetermined amount to leave a clearance between the opening and hosel tube to allow a predetermined amount of tilting of said hosel tube for angular adjustment of the hosel tube prior to welding to the head;

The hosel tube being welded around its periphery to the opening in the crown plate at the selected angle; and the base, face plate and crown plate all comprising stamped sheet metal parts.

2. The head as claimed in claim 1, wherein the crown plate is substantially flat and fits flat against the open top face of the base.

3. A method of making a golf club head of the metal wood type, comprising the steps of:

stamping a head base from sheet metal material, the head base comprising a sole plate formed integrally with a heel, toe and back wall and having an open front face and a substantially flat open top face, the open front face having a lower edge and spaced side edges each comprising a flat, forwardly-facing edge, the side edges each terminating at a junction with the open top face;

stamping a face plate to conform to the shape and dimensions of the open front face of the base;

stamping a crown plate to conform to the shape and dimensions of the open top face of the base, said crown plate having a smooth upper surface with no protrusions;

machining the side and lower edges of the open front face to a selected loft angle;

securing the face plate to the open front face of the base at the selected loft angle;

adjusting the angle of a hosel tube relative to the top face of the base to a selected angle within a predetermined range, and positioning the hosel tube to project into the base at the selected angle; and securing the crown plate and hosel tube to the base with the crown plate extending across the open top face of the base and the hosel tube projecting upwardly from the crown plate at the selected angle.

4. The method as claimed in claim 3, wherein the step of stamping the crown plate comprises forming an opening of larger dimensions than the hosel tube diameter at the peripheral edge of the crown plate adjacent the heel of said base, and the steps of securing the crown plate and hosel tube comprises holding the hosel tube at any selected lie angle with a predetermined range to the base, welding the hosel tube in place, and welding the crown plate to the base and hosel tube.

5. The method as claimed in claim 3, wherein the step of securing the face plate to the base comprises holding the base and face plate together at a selected loft angle in a holding fixture and tack welding around the junction between the parts.

6. The method as claimed in claim 3, wherein the step of machining the open front face comprises machining the side and lower edges to a selected loft angle in the range from 7° to 22°.

7. A golf club head, comprising:

a head base having a sole plate, heel, toe and back wall for a hollow golf club head of the metal-wood type, the base having an open front face and an open top face each having a flat peripheral edge, the peripheral edge of the front face facing forwardly and having opposite sides meeting the peripheral edge of the open top face at the heel and toe of the base to form a pair of corner junctions which are substantially co-planar;

the forwardly-facing peripheral edge of the front face comprising means for machining the open front face to a selected loft angle in a range from 7° to 22°;

a face plate welded across the open front face of the base at the machined loft angle;

a crown plate having a smooth upper surface with substantially no protrusions welded across the open top face of the base;

the crown plate having an opening at its outer peripheral edge adjacent the heel of said base;

a hosel tube extending through said opening into the interior of the head at a selected angle to a position spaced from the sole plate, the opening being of dimensions greater than the diameter of the hosel tube by a predetermined amount and comprising means for allowing a predetermined amount of tilting of said hosel tube for adjustment of the angle of said hosel tube prior to attachment to the head, the hosel tube being welded to the head around the periphery of the crown plate opening at the selected angle.

* * * * *